US008104629B1

(12) United States Patent
Plumer

(10) Patent No.: US 8,104,629 B1
(45) Date of Patent: Jan. 31, 2012

(54) DEVICE FOR DROPPING A FIRST DRINKING VESSEL INTO A SECOND DRINKING VESSEL AND METHOD OF USE

(76) Inventor: Scott S. Plumer, Charlotte, NC (US)

( * ) Notice: Subject to any disclaimer, the term of this patent is extended or adjusted under 35 U.S.C. 154(b) by 478 days.

(21) Appl. No.: 12/321,662

(22) Filed: Jan. 23, 2009

(51) Int. Cl.
*A47B 73/00* (2006.01)

(52) U.S. Cl. ..... 211/74

(58) Field of Classification Search ..... 211/74, 211/85.4; D7/705, 706, 702, 704; 206/139; 220/505
See application file for complete search history.

(56) References Cited

U.S. PATENT DOCUMENTS

| | | | | | |
|---|---|---|---|---|---|
| 72,758 | A | * | 12/1867 | Keistle | 211/74 |
| 1,533,928 | A | * | 4/1925 | Lecopoulos | 211/74 |
| D72,708 | S | * | 5/1927 | Farber | D7/705 |
| D72,709 | S | * | 5/1927 | Farber | D7/702 |
| 1,643,735 | A | * | 9/1927 | Baker | 211/85.4 |
| D91,509 | S | * | 2/1934 | Botham | D6/457 |
| D165,303 | S | * | 11/1951 | Rogers et al. | D7/706 |
| 2,749,004 | A | * | 6/1956 | Hilts et al. | 141/100 |
| 3,091,343 | A | * | 5/1963 | Neumann | 211/74 |
| 3,163,320 | A | * | 12/1964 | Monk | 206/139 |
| 3,353,717 | A | * | 11/1967 | Edwards | 222/132 |
| 3,674,198 | A | * | 7/1972 | Eberle | 494/7 |
| 3,842,981 | A | * | 10/1974 | Lambert | 211/74 |
| D233,723 | S | * | 11/1974 | Guitierrez | D7/704 |
| 3,966,102 | A | * | 6/1976 | Clark | 294/160 |
| 4,294,384 | A | * | 10/1981 | Howell | 224/540 |
| 4,606,523 | A | * | 8/1986 | Statz et al. | 248/311.2 |
| 5,715,953 | A | * | 2/1998 | Brown | 211/74 |
| 6,062,398 | A | * | 5/2000 | Thalmayr | 211/74 |
| 6,796,441 | B2 | * | 9/2004 | Tremblay | 211/74 |
| 2003/0226447 | A1 | * | 12/2003 | Flick | 99/275 |
| 2004/0026429 | A1 | * | 2/2004 | Baldewsingh et al. | 220/574.1 |
| 2006/0065659 | A1 | * | 3/2006 | Schilling et al. | 220/505 |
| 2006/0081750 | A1 | * | 4/2006 | Kazyaka | 248/311.2 |
| 2007/0201306 | A1 | * | 8/2007 | Wulf et al. | 366/205 |
| 2008/0128429 | A1 | * | 6/2008 | Towery et al. | 220/574 |
| 2010/0000980 | A1 | * | 1/2010 | Popescu | 219/201 |
| 2010/0126353 | A1 | * | 5/2010 | Winberry et al. | 99/275 |
| 2010/0170838 | A1 | * | 7/2010 | Falcone | 210/222 |

* cited by examiner

*Primary Examiner* — Sarah Purol
(74) *Attorney, Agent, or Firm* — Ted Masters

(57) ABSTRACT

A device and method for dropping a first drinking vessel into a second drinking vessel includes a holder which outwardly projects from a support member. The holder releaseably suspends the first drinking vessel over the second drinking vessel, so that when the second drinking vessel is pulled away from the support member, the first drinking vessel detaches from the holder and drops into the second drinking vessel.

14 Claims, 9 Drawing Sheets

Fig. 6
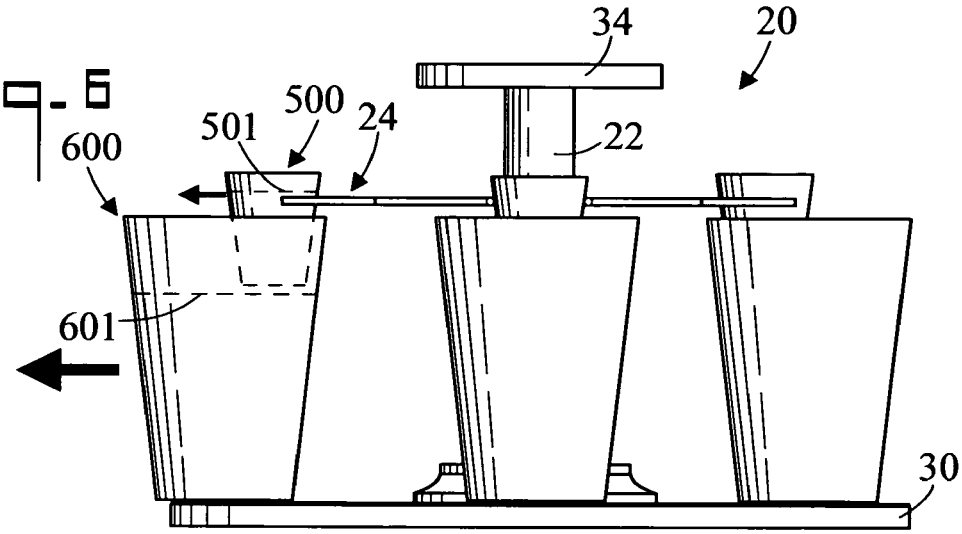
Fig. 7
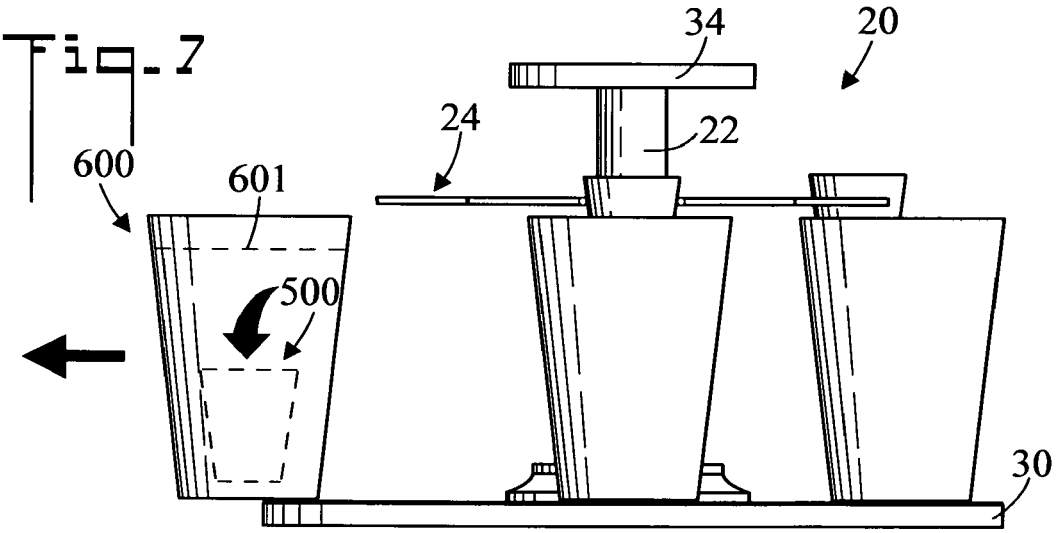
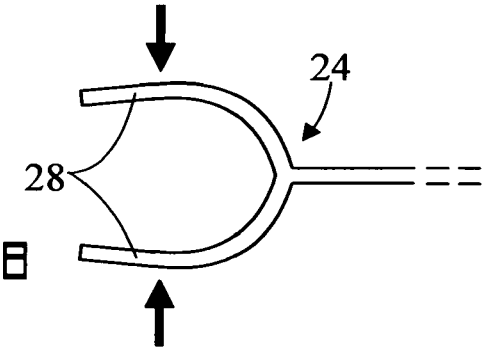
Fig. 8

Fig. 9
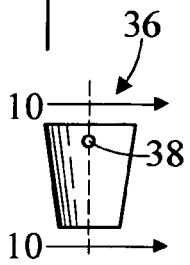
Fig. 10
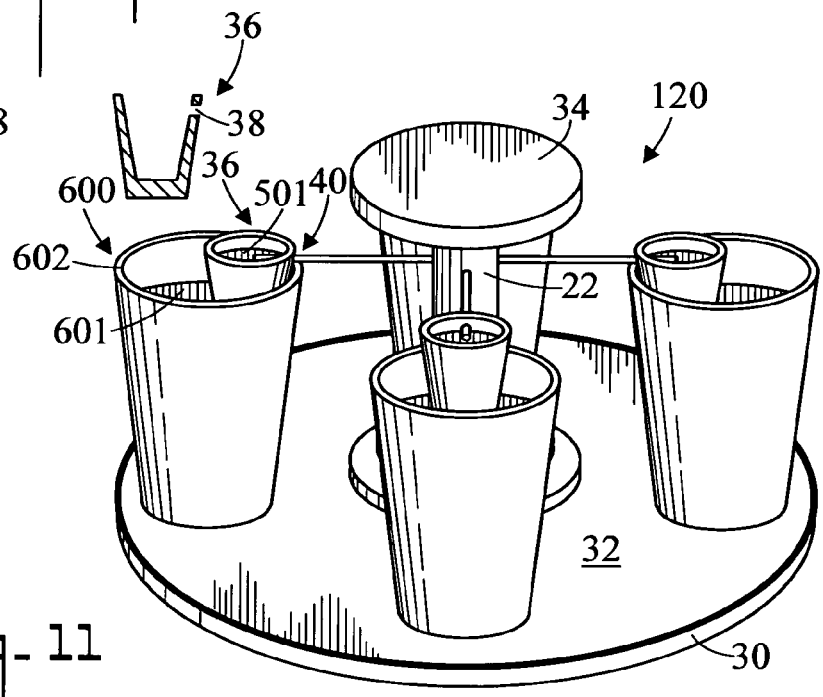
Fig. 11
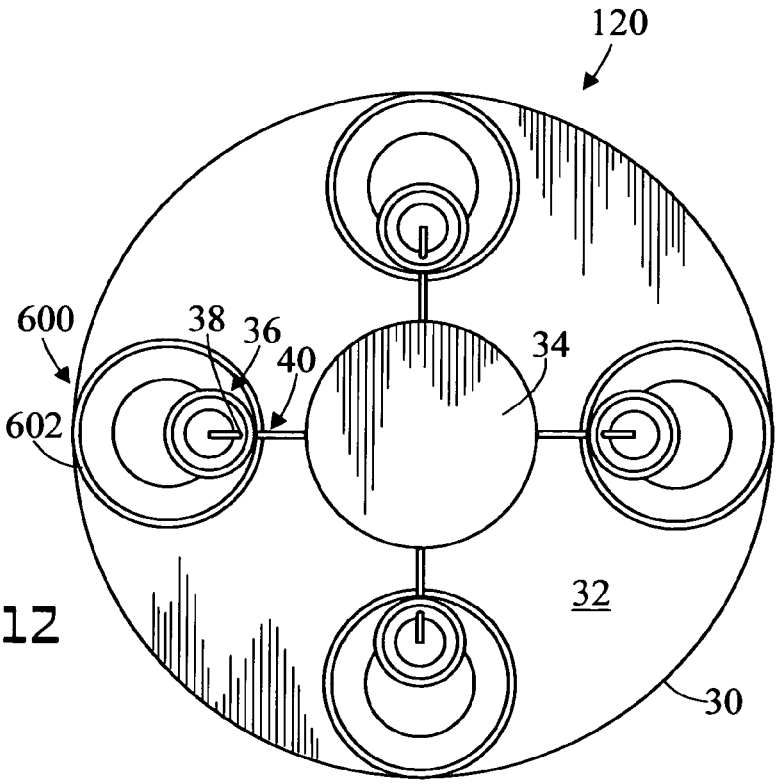
Fig. 12

Fig. 21
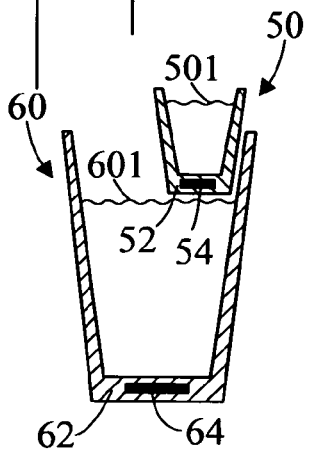
Fig. 22
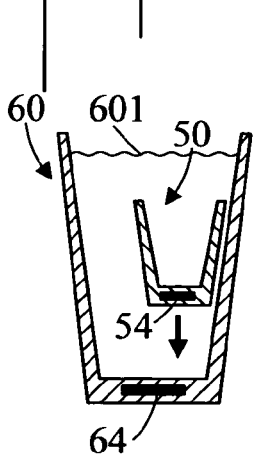
Fig. 23
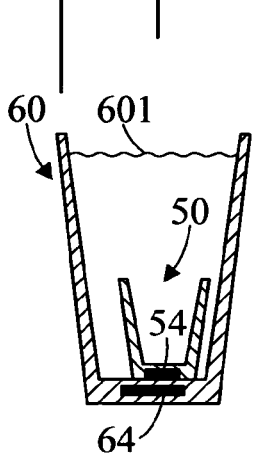
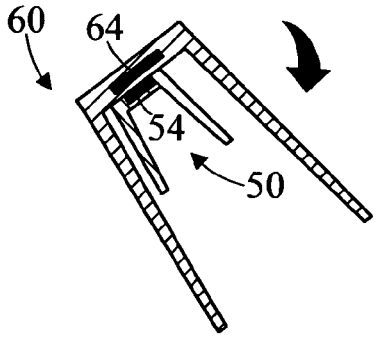
Fig. 24

DEVICE FOR DROPPING A FIRST DRINKING VESSEL INTO A SECOND DRINKING VESSEL AND METHOD OF USE

CROSS REFERENCE TO RELATED APPLICATION

None.

TECHNICAL FIELD

The present invention pertains generally to drinking, and more particularly to a method of drinking wherein a drinking vessel containing a first beverage is dropped into a drinking vessel containing a second beverage.

BACKGROUND OF THE INVENTION

A popular form of drinking is know as "bomb shots". A bomb shot typically comprises a shot glass filled with some form of liquor, and a larger glass filled with another beverage. The shot glass is dropped into the larger glass and the combined beverages are then consumed. In one such drink called a "boilermaker", a shot glass full of whiskey is dropped into a partially filled glass of beer. When the shot glass strikes the bottom of the larger glass, the carbonation of the beer causes a foaming action. Similar varieties of bomb shots include various other forms of liquor, and even energy drinks, dropped into beer, another alcoholic beverage, or a non-alcoholic beverage such as a soft drink.

BRIEF SUMMARY OF THE INVENTION

The present invention is directed to a device and method which facilitates the drinking of bomb shots. The device allows a first drinking vessel such as a shot glass to be suspended over a second drinking vessel such as a pint glass. A holder connected to a support member is used to suspend the first drinking vessel over the second drinking vessel. The second drinking vessel resides upon the base of the device. When the user pulls the second drinking vessel away from the support member, the first drinking vessel comes off of the holder and drops into the second drinking vessel. The device can also be used to easily transport the full drinking vessels such as from a bar to a customer's table. And, since the first drinking vessel is suspended over the second drinking vessel, any liquid that is inadvertently spilled from the first drinking vessel will not be wasted but will simply fall into the second drinking vessel. In an embodiment of the invention, the device includes a plurality of holders so that a corresponding plurality of users can simultaneously use the device.

In accordance with a preferred embodiment of the invention, a device for dropping a first drinking vessel into a second drinking vessel includes a support member. A holder is connected to and outwardly projecting from the support member. The holder is shaped and dimensioned to suspend the first drinking vessel over the second drinking vessel. When the first drinking vessel is so suspended, if the second drinking vessel is pulled away from the support member, the first drinking vessel separates from the holder and drops into the second drinking vessel.

In accordance with an aspect of the invention, the holder is positioned, shaped, and dimensioned so that when the first drinking vessel is suspended over the second drinking vessel the first drinking vessel extends below the rim of the second drinking vessel.

In accordance with another aspect of the invention, a base is connected to the support member. The holder is disposed a height above the base which is greater than the height of the second drinking vessel.

In accordance with another aspect of the invention, the base has a friction enhancing material of its top surface.

In accordance with another aspect of the invention, the holder includes a proximal end connected to the support member and an opposite distal end. The distal end has two spaced apart arms which are shaped and dimensioned to receive and suspend the first drinking vessel.

In accordance with another aspect of the invention, a handle is connected to the top of the support member.

In accordance with another aspect of the invention, a plurality of holders are connected to the support member and project out in different directions therefrom.

In accordance with another aspect of the invention, the first drinking vessel has a top portion which has an aperture. The holder includes a rod which is shaped and dimensioned to pass through the aperture of said first drinking vessel and suspend said first drinking vessel over the second drinking vessel.

In accordance with another aspect of the invention, the first drinking vessel has a top portion which has an aperture, and the second drinking vessel also has a top portion having a second aperture. The holder includes a rod which is shaped and dimensioned to pass through both the aperture of the first drinking vessel and the second aperture of the second drinking vessel and suspend the first drinking vessel over the second drinking vessel. As such, the height of the holder is slightly less than the height of the second drinking vessel.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 6 is a side elevation view showing the second drinking vessel being pulled away from a support member;

FIG. 7 is a side elevation view showing the first drinking vessel dropping into the second drinking vessel;

FIG. 8 is fragmented top plan view of a second embodiment holder;

FIG. 9 is a front elevation view of a special first drinking vessel;

FIG. 10 is a cross sectional view along the line 10-10 of FIG. 9;

FIG. 11 is a perspective view of a second embodiment of the device;

FIG. 12 is a top plan view of the second embodiment;

FIG. 21 is a cross sectional view of a pair of drinking vessels;

FIG. 22 is a cross sectional view of a first drinking vessel dropping into a second drinking vessel;

FIG. 23 is a cross sectional view of the first drinking vessel residing at the bottom of the second drinking vessel; and, FIG. 24 is a cross sectional view of the second drinking vessel placed in an inverted position.

DETAILED DESCRIPTION OF THE INVENTION

Figure 1:
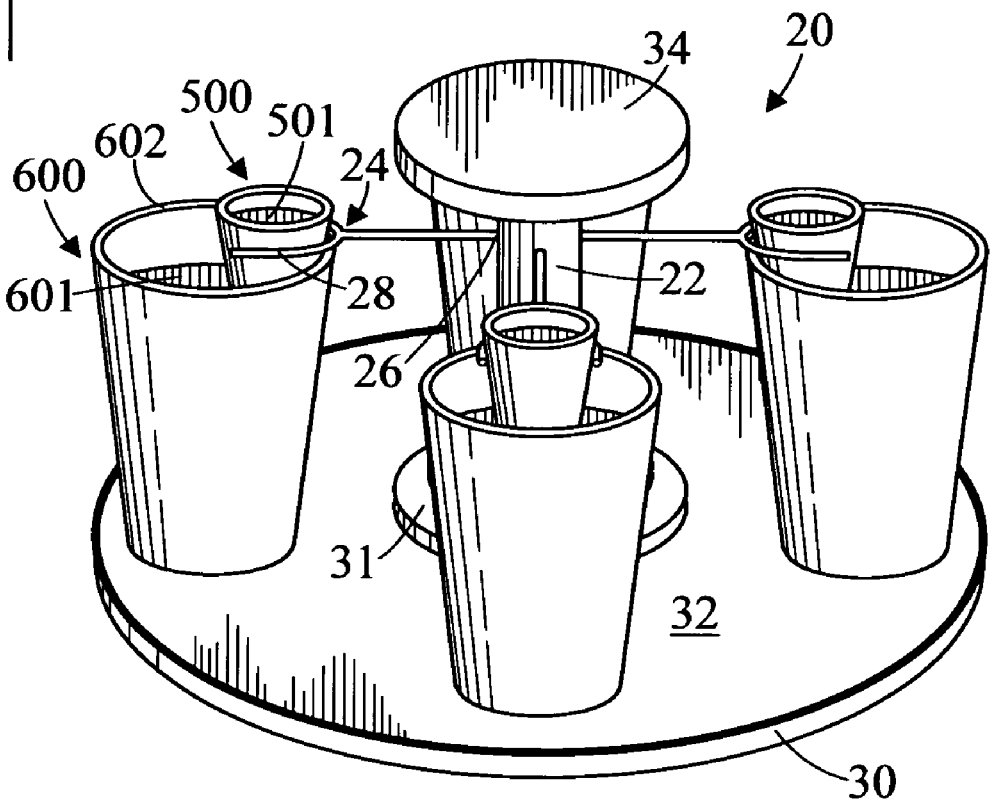
FIG. 1 is a perspective view of a device for dropping a first drinking vessel into a second drinking vessel in accordance with the present invention.
Figure 2:
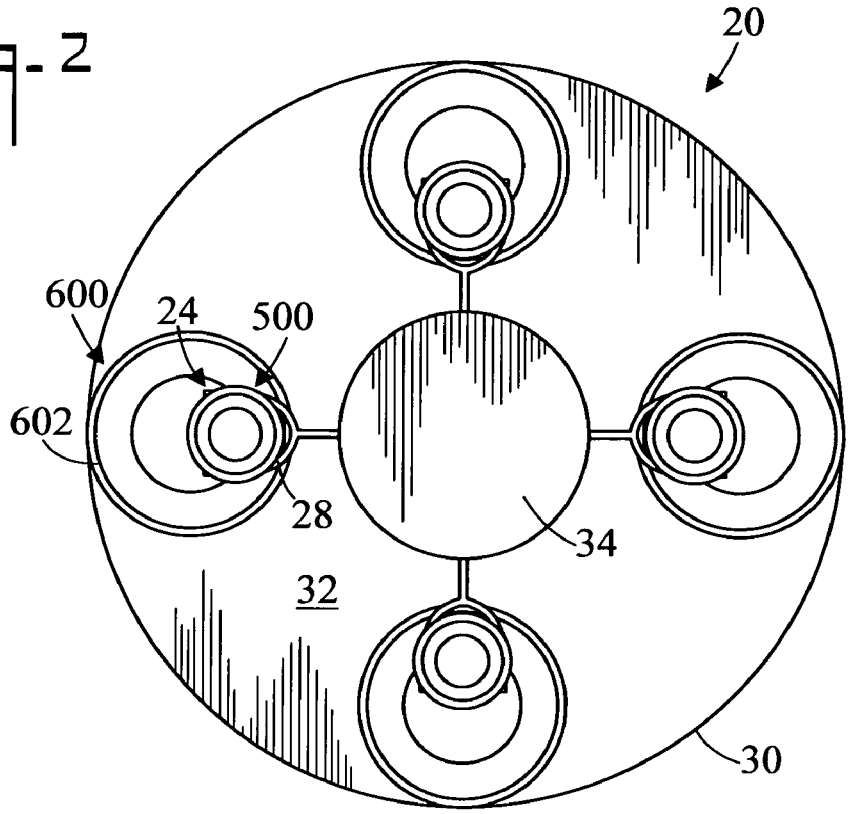
FIG. 2 is a top plan view of the device.
Figure 3:
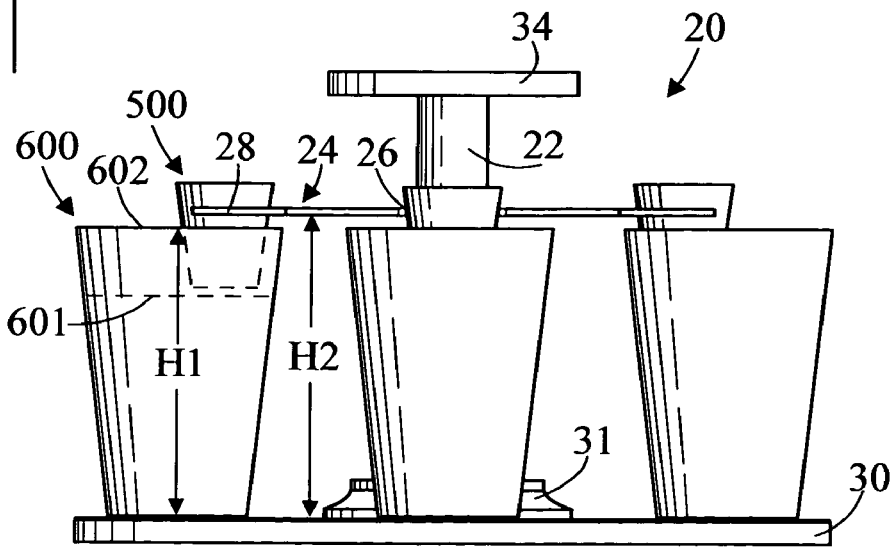
FIG. 3 is a side elevation view of the device.

Referring initially to FIGS. 1-3, there are illustrated perspective, top plan, and side elevation views respectively of a device for dropping a first drinking vessel 500 into a second drinking vessel 600, the device generally being designated as 20. First drinking vessel 500 can be a conventional shot glass, and second drinking vessel can be a conventional pint glass. In use, first drinking vessel 500 is filled with a first beverage 501, and second drinking vessel 600 is filled with a second beverage 601. First beverage 501 is usually, but not manditorily, different from second beverage 601. Device 20 includes a support member 22, which in the shown embodiment is a vertical post (also refer to FIG. 5). Device 20 further includes a holder 24 which is connected to and outwardly projects from support member 22. In the shown embodiment, holder 24 horizontally projects from support member 22. Also in the shown embodiment, a plurality of holders 24 are connected to support member 22 and project out in different directions therefrom. The plurality of holders 24 accommodates a corresponding plurality of first 500 and second 600 drinking vessels. Four holders 24 and corresponding drinking vessel sets are shown, however it may be appreciated that two, three, five, six, etc. holders 24 could also be utilized.

Holder 24 is shaped and dimensioned to suspend first drinking vessel 500 over second drinking vessel 600. To that end, holder 24 includes a proximal end 26 which is connected to support member 22, and an opposite bifurcated distal end which has two spaced apart arms 28 which are shaped and dimensioned to receive and suspend first drinking vessel 500 over second drinking vessel 600. First drinking vessel 500 is tapered in the conventional manner from rim to bottom. Arms 28 are spaced apart further than the bottom of first drinking vessel 500, but less than the rim of first drinking vessel 500. As such, first drinking vessel 500 may be suspended (hung) between arms 28 in the shown manner. It is further noted, that second drinking vessel 600 has a rim 602. Holder 24 is positioned, shaped, and dimensioned so that when first drinking vessel 500 is suspended over second drinking vessel 600 first drinking vessel 500 extends below rim 602 of second drinking vessel 600. This is shown in FIG. 3 where the bottom portion of first drinking vessel 500 (shown in dashed lines) is below rim 602 of second drinking vessel 600. When first drinking vessel 500 is so suspended, if second drinking vessel 600 is pulled away from support member 22, first drinking vessel 500 separates from holder 24 and drops into second drinking vessel 600. In other words, second drinking vessel 600 pulls first drinking vessel 500 off of arms 28 of holder 24 (refer to FIGS. 6 and 7 and the associated discussions).

It is also noted that second drinking vessel 600 has a height H1. A base 30 is connected to support member 22. In the shown embodiment, base 30 is disc-shaped, and is connected to support member 22 by decorative flange 31. Second drinking vessel 600 resides on base 30. Holder 24 is disposed a height H2 above base 30 which is greater than height H1 of second drinking vessel 600. This relationship ensures that second drinking vessel 600 will fit underneath holder 24. In an embodiment of the invention, base 30 has a top surface. A friction enhancing material 32 (such as a rubber sheet) is disposed on the top surface of base 30. Friction enhancing material 32 helps hold second drinking vessels 600 in place during transport of device 20.

Support member 22 has a top. A handle 34 for transporting device 20 is connected to the top of support member 22. In the shown embodiment, handle 34 includes a disc-shaped shelf which is also useful in stacking a plurality of devices 20.

Figure 4:
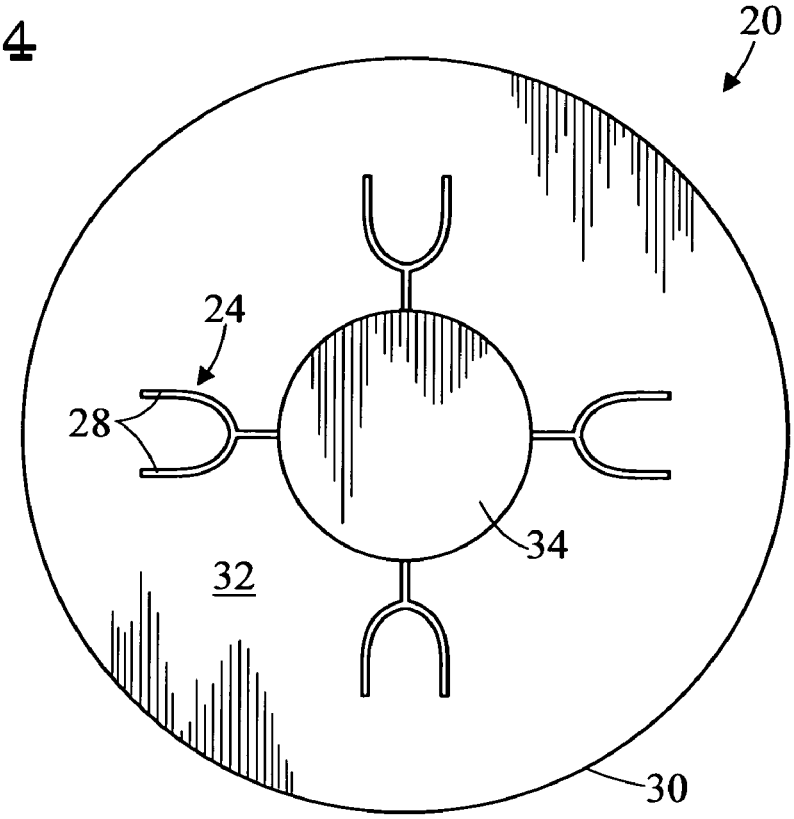
FIG. 4 is a top plan view of the device without the drinking vessels.
Figure 5:
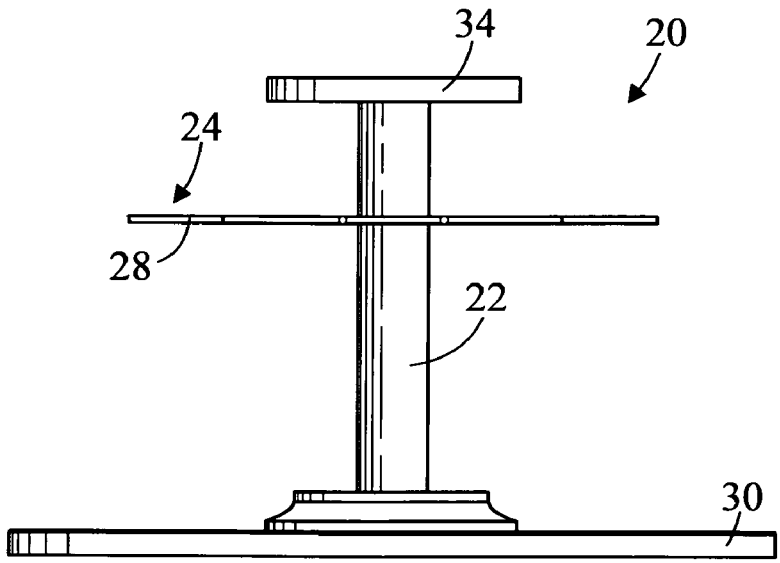
FIG. 5 is a side elevation view of the device without the drinking vessels.

FIGS. 4 and 5 are top plan and side elevation views respectively of device 20 without the cooperating first and second drinking vessels 500 and 600. Device 20 includes support member 22, holder 24, arms 28, base 30, friction enhancing material 32, and handle 34. As in FIGS. 1-3, a plurality of holders 24 are shown.

FIG. 6 is a side elevation view showing second drinking vessel 600 being pulled away from support member 22, and FIG. 7 is a side elevation view showing first drinking vessel 500 dropping into second drinking vessel 600. A user grasps second drinking vessel 600 and pulls it away from support member 22 in the direction of the arrow. In so doing, first drinking vessel 500 is pulled (dragged) off of holder 24 and falls into second drinking vessel 600. It may be appreciated that in one possible use of device 20, a plurality of users simultaneously pull their second drinking vessels 600 away from support member 22 causing their respective first drinking vessels 500 to drop into their second drinking vessels 600.

FIG. 8 is fragmented top plan view of a second embodiment holder 24. In this embodiment, arms 28 of holder 24 are resiliently biased toward one another. As such, arms grip first drinking vessel 500 when it is inserted therebetween. In the shown embodiment arms are fabricated from a resilient material such as a polymer, however a spring mechanism could also be utilized to effect the inward biasing.

Figure 13:
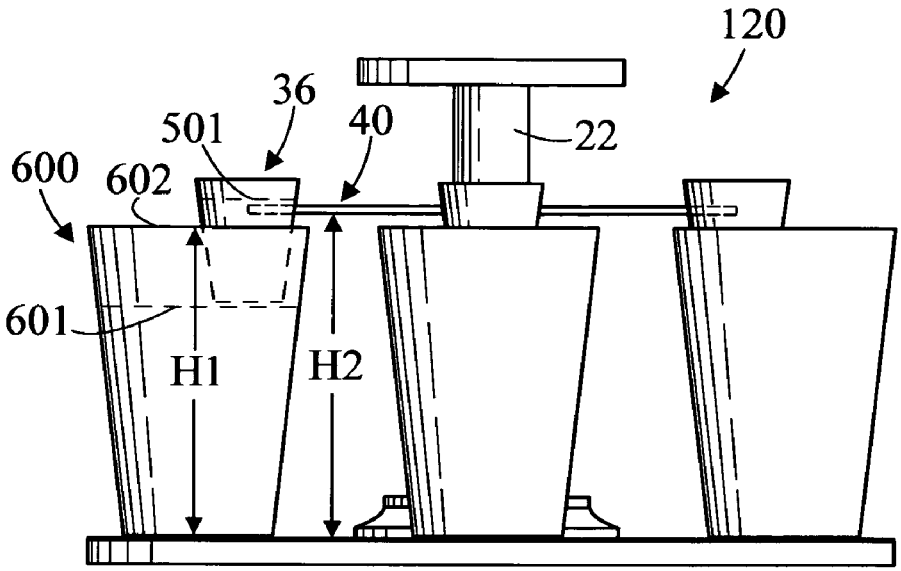
FIG. 13 is a side elevation view of the second embodiment.

FIGS. 9-14 illustrate a second embodiment of the present invention, generally designated as 120. In this embodiment, a special first drinking vessel 36 is part of the invention. FIGS. 9 and 10 are front elevation and cross sectional views respectively of special first drinking vessel 36. First drinking vessel 36 has a top portion which has an aperture 38. Referring now to FIGS. 11-13, holder 40 includes a rod which outwardly projects from support member 22 and is shaped and dimensioned to pass through aperture 38 of first drinking vessel 36 and suspend first drinking vessel 36 over second drinking vessel 600. That is, in device 120 special first drinking vessel 36 is suspended by aperture 38, as opposed to conventional first drinking vessel 500 being suspended between arms 28 of holder 24 as in device 20. In device 120, support member 22, base 30, friction enhancing material 32, and handle 34 are the same as in device 20 as described above. Also, as in device 20, holder 40 is positioned, shaped, and dimensioned so that when first drinking vessel 36 is suspended over second drinking vessel 600 first drinking vessel 36 extends below the rim 602 of second drinking vessel 600. And, holder 40 is disposed a height H2 above base 30 which is greater than the height H1 of second drinking vessel 600 (refer to FIG. 13). And also, a plurality of holders 40 may be connected to support member 22 and project out in different directions therefrom.

Figure 14:
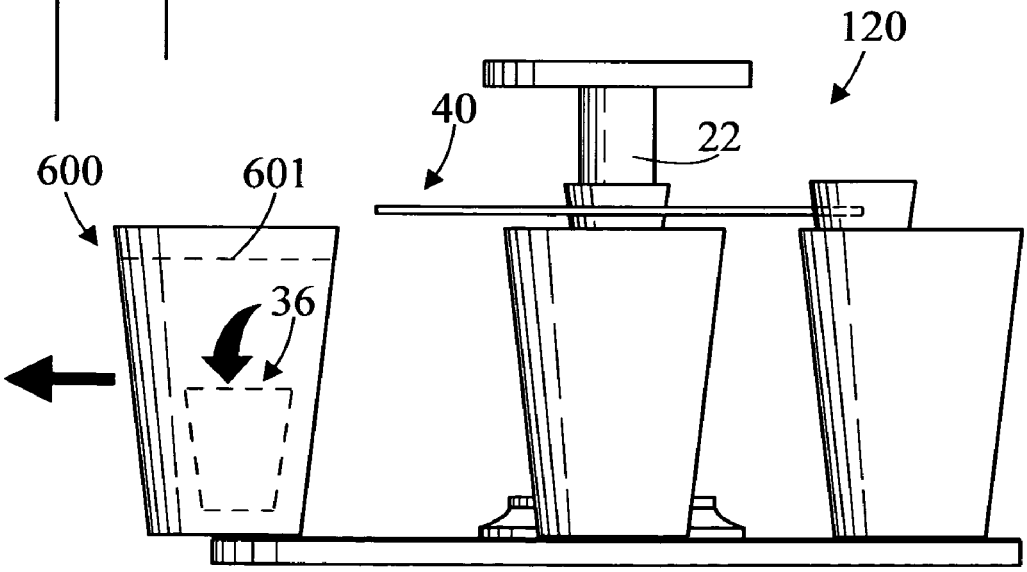
FIG. 14 is a side elevation view of the second embodiment showing the first drinking vessel dropping into the second drinking vessel.

FIG. 14 is a side elevation view showing first drinking vessel 36 dropping into second drinking vessel 600. Just as with device 20, the user grasps second drinking vessel 600 and pulls it away from support member 22 causing first drinking vessel 36 to separate from holder 40. In so doing, first drinking vessel 36 is pulled (dragged) off of holder 40 and drops into second drinking vessel 600. It may be appreciated that in one possible use of device 120, a plurality of users simultaneously pull their second drinking vessels 600 away from support member 22 causing their respective first drinking vessels 36 to drop into their second drinking vessels 600.

Figure 15:
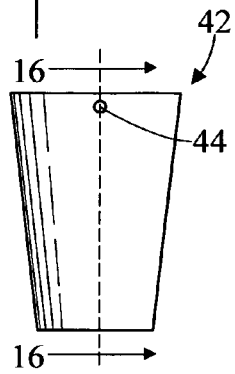
FIG. 15 is a front elevation view of a special second drinking vessel.
Figure 17:
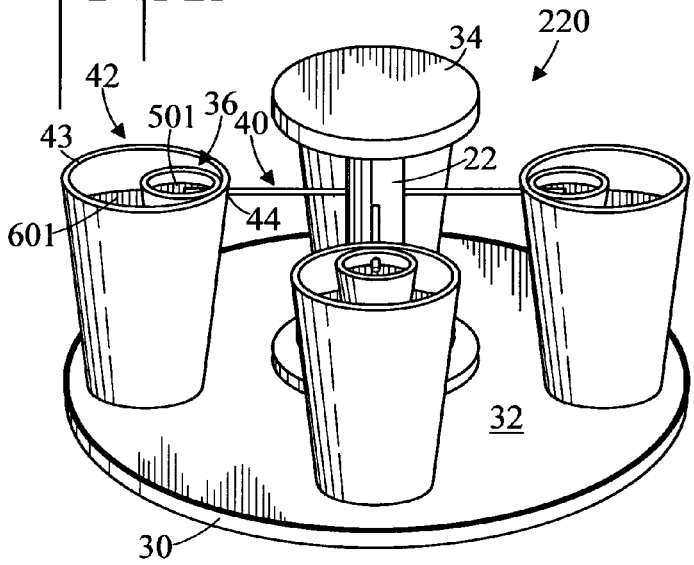
FIG. 17 is a perspective view of a third embodiment of the device.
Figure 16:
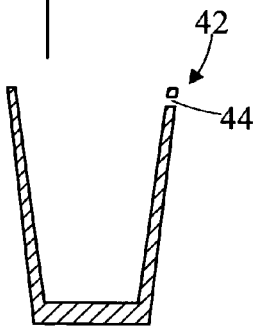
FIG. 16 is a cross sectional view along the line 16-16 of FIG. 15.
Figure 18:
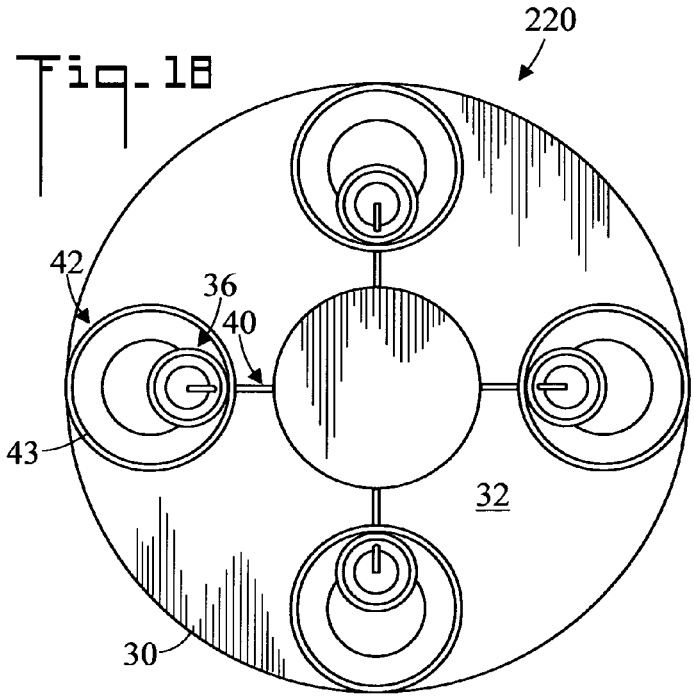
FIG. 18 is a top plan view of the third embodiment.
Figure 19:
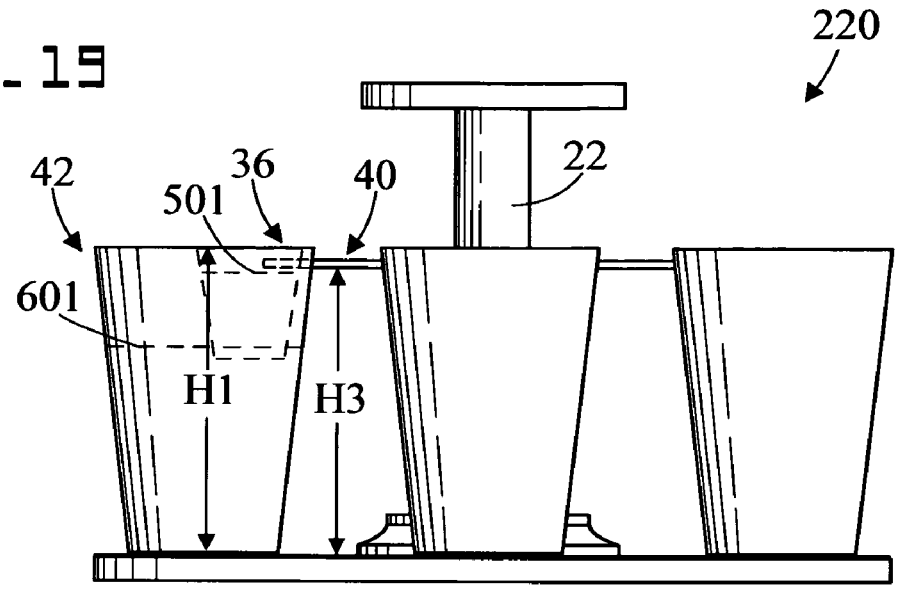
FIG. 19 is a side elevation view of the third embodiment.

FIGS. 15-20 illustrate a third embodiment of the device of the present invention, generally designated as 220. In this embodiment, a special second drinking vessel 42 is part of the invention along with special first drinking vessel 36. FIGS. 15 and 16 are front elevation and cross sectional views respectively of special second drinking vessel 42. Second drinking vessel 42 has a top portion which has a second aperture 44. Referring now to FIGS. 17-19, holder 40 includes a rod 40 which outwardly projects from support member 22 and is shaped and dimensioned to pass through both aperture 38 of first drinking vessel 36 (refer to FIGS. 9 and 10) and second aperture 44 of second drinking vessel 42 (refer to FIGS. 15 and 16), and to suspend first drinking vessel 36 over second drinking vessel 42. That is, in device 220 holder 40 passes through the apertures in both drinking vessels. Holder 40 is positioned, shaped, and dimensioned so that when first drinking vessel 36 is suspended over second drinking vessel 42 first drinking vessel 36 extends below the rim 43 of second drinking vessel 42. However unlike device 120, in device 220 holder 40 is downwardly positioned somewhat on support member 22 so that holder 40 is aligned with aperture 44 in second drinking vessel 42. To that end, holder 40 is disposed a height H3 above base 30 which is less than the height H1 of second drinking vessel 600 (refer to FIG. 19). In device 220, support member 22, base 30, friction enhancing material 32, and handle 34 are the same as in devices 20 and 120 described above. And also as in device 120, a plurality of holders 40 may be connected to support member 22 and project out in different directions therefrom.

Figure 20:
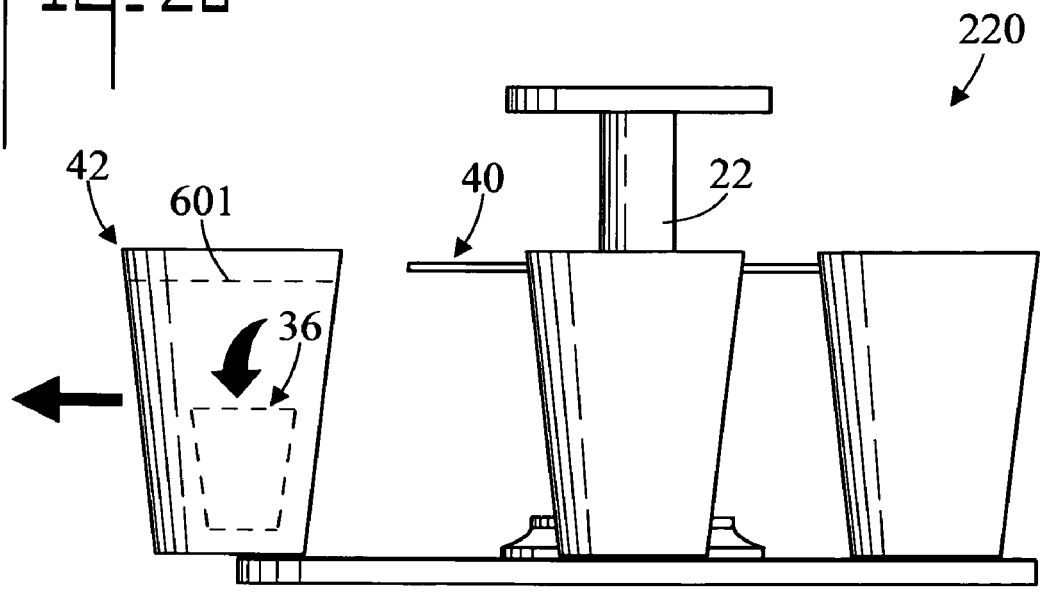
FIG. 20 is a side elevation view of the third embodiment showing the first drinking vessel dropping into the second drinking vessel.

FIG. 20 is a side elevation view showing first drinking vessel 36 dropping into second drinking vessel 42. The user grasps second drinking vessel 42 and pulls it away from support member 22 causing first drinking vessel 36 to separate from holder 40. In so doing, first drinking vessel 36 is pulled (dragged) off of holder 40 and drops into second drinking vessel 42. It may be appreciated that in one possible use of device 220, a plurality of users simultaneously pull their second drinking vessels 42 away from support member 22 causing their respective first drinking vessels 36 to drop into their second drinking vessels 42.

It is noted that device 220 has some advantages with respect devices 20 and 120. By having aperture 44 through which the rod of holder 40 passes, second drinking vessel 42 is better stabilized during transport. Also, since both drinking vessels are on holder 40, first drinking vessel 36 more easily slides into second drinking vessel 42. And, lastly first drinking vessel 36 is positioned lower with respect to second drinking vessel 42 thereby reducing the possibility of splashing when dropped. Conversely, device 220 has the disadvantage that it requires two specialized drinking vessels each of which must have a hole. Device 120 also has the disadvantage of requiring one specialized drinking vessel with a hole.

In terms of fabrication, device 20 can be fashioned from materials such as metal, wood, or a polymer. In devices 120, and 220, the additional drinking vessels 36 and 42 can be fashioned from glass or other suitable materials. Similarly, the first and second drinking vessels 50 and 60 of FIGS. 21-24 can be fashioned from glass or other suitable materials.

In terms of use, a method for dropping a first drinking vessel into a second drinking vessel includes: (refer to FIGS. 1-20)

(a) providing a first drinking vessel 500 or 36;

(b) providing a second drinking vessel 600 or 42;

(c) providing a first beverage 501;

(d) providing a second beverage 601;

(e) providing a support member 22, and a holder 24 or 40 connected to and outwardly projecting from support member 22, holder 24 or 40 shaped and dimensioned to suspend first drinking vessel 500 or 36 over second drinking vessel 600 or 42;

(f) positioning first drinking vessel 500 or 36 on holder 24 or 40 and positioning second drinking vessel 600 or 42 so that first drinking vessel 500 or 36 is suspended over second drinking vessel 600 or 42;

(g) filling first drinking vessel 500 or 36 with the first beverage 501 and filling second drinking vessel 600 or 42 with the second beverage 601; and, (h) pulling second drinking vessel 600 or 42 away from support member 22 thereby causing first drinking vessel 500 or 36 to separate from holder 24 or 40 and drop into second drinking vessel 600 or 42.

The method further including: (refer to FIGS. 1-8)

in step (e), holder 24 includes a proximal end 26 connected to support member 22, and an opposite distal end having two spaced apart arms 28 which are shaped and dimensioned to receive and suspend first drinking vessel 500; and, in step (f), the positioning including placing first drinking vessel 500 between two arms 28.

The method further including: (refer to FIGS. 9-14)

in step (a), first drinking vessel 36 having a top portion having an aperture 38;

in step (e), holder 40 including a rod which is shaped and dimensioned to pass through aperture 38 of first drinking vessel 36; and, in step (f), the positioning including causing the rod to enter aperture 38.

The method further including: (refer to FIGS. 15-20)

in step (a), first drinking vessel 36 having a top portion having an aperture 38;

in step (b), second drinking vessel 42 having a top portion having a second aperture 44;

in step (e), holder 40 including a rod which is shaped and dimensioned to pass through both aperture 38 of first drinking vessel 36 and second aperture 44 of second drinking vessel 42; and, in step (f), the positioning including causing the rod to first enter second aperture 44 in second drinking vessel 42 and then enter aperture 38 in first drinking vessel 36.

The method further including:

in step (e), support member 22 having a top;

a handle 34 connected to the top of support member 22; and, after step (g) and before step (h), using handle 34 to transport support member 22, holder 24 or 40, first drinking vessel 500 or 36 which contains first beverage 501, and second drinking vessel 600 or 42 which contains second beverage 601, from a first location to a second location. For example, a bartender would fill both drinking vessels at the bar, and then a waiter or waitress would use handle 34 to carry the drinks to a customer's table.

The method further including:

in step (a), providing a plurality of first drinking vessels 500 or 36;

in step (b), providing a corresponding plurality of second drinking vessels 600 or 42;

in step (e), providing a corresponding plurality of holders 24 or 40 connected to support member 22 and projecting out in different directions therefrom;

in step (f), positioning one of the first drinking vessels 500 or 36 on each of holders 24 or 40, and positioning one of the second drinking vessels 600 or 42 beneath each first drinking vessel 500 or 36;

in step (g), filling each of the first drinking vessels 500 or 36 with first beverage 501, and filling each of the second drinking vessels 600 or 42 with second beverage 601; and, in step (h), pulling each of the second drinking vessels 600 or 42 away from support member 22.

In another embodiment of the invention, FIG. 21 is a cross sectional view of a pair of drinking vessels wherein one drinking vessel may be dropped into the other drinking vessel. The pair of drinking vessels include a first drinking vessel 50 and a second drinking vessel 60. Second drinking vessel 60 is shaped and dimensioned to receive first drinking vessel 50. First drinking vessel 50 and second drinking vessel 60 each contain magnetic material so that first drinking vessel 50 is magnetically attracted to second drinking vessel 60. In the shown embodiment, first drinking vessel has a first bottom portion 52, and the magnetic material 54 is disposed in first bottom portion 52. Similarly, second drinking vessel 60 has a second bottom portion 62, and the magnetic material 64 is disposed in second bottom portion 64. It may be appreciated that the magnetic attraction of first drinking vessel 50 for second drinking vessel 60 may be effected in different ways. For example, magnetic material 54 could be a magnet, and magnetic material 64 could be a ferrous metal, or visa versa. Alternately, both magnetic material 54 and 64 could be magnets.

FIG. 22 is a cross sectional view of first drinking vessel 50 dropping into second drinking vessel 60. Both gravity and the magnetic attraction cause first drinking vessel to migrated toward bottom 62 of second drinking vessel 60.

FIG. 23 is a cross sectional view of first drinking vessel 50 residing at bottom portion 62 of second drinking vessel 60. When first drinking vessel 50 is dropped into second drinking vessel 60, the magnetic attraction causes first drinking vessel 50 to be captively held by second drinking vessel 60.

FIG. 24 is a cross sectional view of second drinking vessel 60 placed in an inverted position (tilted so any beverage will run out). Because of the magnetic attraction, when second drinking vessel 60 is so inverted, first drinking vessel 50 will remain attached to second drinking vessel 60. In other words, when a user inverts and drinks out of second drinking vessel 60, first drinking vessel 50 will not fall and strike the user in the mouth.

In terms of use, a method for using a first drinking vessel and a second drinking vessel includes: (refer to FIGS. 21-24)

(a) providing a pair of drinking vessels including a first drinking vessel 50 and a second drinking vessel 60 shaped and dimensioned to receive the first drinking vessel 50, the first drinking vessel 50 and the second drinking vessel 60 each containing magnetic material so that the first drinking vessel 50 is magnetically attracted to the second drinking vessel 60;

(b) providing a first beverage;

(c) providing a second beverage;

(d) filling the first drinking vessel 50 with the first beverage and filling the second drinking vessel 60 with the second beverage;

(e) dropping the first drinking vessel 50 into the second drinking vessel 60 wherein the first beverage mixes with the second beverage; and, (f) inverting the second drinking vessel 60 and drinking the mixed beverages, wherein the magnetic attraction of the first 50 and second 60 drinking vessels causes the first drinking vessel 50 to remain attached to the second drinking vessel 60.

The preferred embodiments of the invention described herein are exemplary and numerous modifications, variations, and rearrangements can be readily envisioned to achieve an equivalent result, all of which are intended to be embraced within the scope of the appended claims.

I claim:

1. A system for drinking, comprising:

a first drinking glass;

a second drinking glass;

a support member;

a holder connected to and outwardly projecting from said support member, said holder shaped and dimensioned to suspend said first drinking glass over said second drinking glass; and, when said first drinking glass is so suspended, if said second drinking glass is pulled away from said support member, said first drinking glass separates from said holder and drops into said second drinking glass said second drinking glass having a rim; said holder positioned, shaped, and dimensioned so that when said first drinking glass is suspended over said second drinking glass said first drinking glass extends below said rim of said second drinking glass.

2. The system according to claim 1, further including:

said second drinking glass having a height;

a base connected to said support member; and, said holder disposed a height above said base which is greater than the height of said second drinking glass.

3. The system according to claim 2, further including:

said base having a top surface; and, a friction enhancing material disposed on said top surface of said base.

4. A device for dropping a first drinking vessel into a second drinking vessel, comprising:

a first drinking vessel having a top portion having an aperture;

a support member;

a holder connected to and outwardly projecting from said support member, said holder including a rod which is shaped and dimensioned to pass through said aperture of said first drinking vessel and suspend said first drinking vessel over the second drinking vessel; and, when said first drinking vessel is so suspended, if the second drinking vessel is pulled away from said support member, said first drinking vessel separates from said holder and drops into the second drinking vessel.

5. The device according to claim 4, the second drinking vessel having a rim, said device further including:

said holder positioned, shaped, and dimensioned so that when said first drinking vessel is suspended over the second drinking vessel said first drinking vessel extends below the rim of the second drinking vessel.

6. The device according to claim 4, the second drinking vessel having a height, said device further including:

a base connected to said support member; and, said holder disposed a height above said base which is greater than the height of the second drinking vessel.

7. The device according to claim 4, further including:

said base having a top surface; and, a friction enhancing material disposed on said top surface of said base.

8. A device for dropping a first drinking vessel into a second drinking vessel, comprising:

a first drinking vessel having a top portion having an aperture;

a second drinking vessel having a top portion having a second aperture;

a support member;

a holder connected to and outwardly projecting from said support member, said holder including a rod which is shaped and dimensioned to pass through both said aperture of said first drinking vessel and said second aperture of said second drinking vessel and suspend said first drinking vessel over said second drinking vessel; and, when said first drinking vessel is so suspended, if said second drinking vessel is pulled away from said support member, said first drinking vessel separates from said holder and drops into said second drinking vessel.

9. The device according to claim 8, further including:

said second drinking vessel having a height;

a base connected to said support member; and, said holder disposed a height above said base which is less than the height of said second drinking vessel.

10. The device according to claim 8, further including:

said base having a top surface; and, a friction enhancing material disposed on said top surface of said base.

11. A method for dropping a first drinking vessel into a second drinking vessel, comprising:

(a) providing a first drinking vessel;

(b) providing a second drinking vessel;

(c) providing a first beverage;

(d) providing a second beverage;

(e) providing a support member and a holder connected to and outwardly projecting from said support member, said holder shaped and dimensioned to suspend said first drinking vessel over said second drinking vessel;

(f) positioning said first drinking vessel on said holder and positioning said second drinking vessel so that said first drinking vessel is suspended over said second drinking vessel;

(g) filling said first drinking vessel with said first beverage and filling said second drinking vessel with said second beverage; and, (h) pulling said second drinking vessel away from said support member thereby causing said first drinking vessel to separate from said holder and drop into said second drinking vessel.

12. The method of claim 11, further including:

in step (a), said first drinking vessel having a top portion having an aperture;

in step (e), said holder including a rod which is shaped and dimensioned to pass through said aperture of said first drinking vessel; and, in step (f), said positioning including causing said rod to enter said aperture.

13. The method of claim 11, further including:

in step (a), said first drinking vessel having a top portion having an aperture;

in step (b), said second drinking vessel having a top portion having a second aperture;

in step (e), said holder including a rod which is shaped and dimensioned to pass through both said aperture of said first drinking vessel and said second aperture of said second drinking vessel; and, in step (f), said positioning including causing said rod to first enter said second aperture in said second drinking vessel and then enter said aperture in said first drinking vessel.

14. The method of claim 11, further including:

in step (a), providing a plurality of said first drinking vessels;

in step (b), providing a corresponding plurality of said second drinking vessels;

in step (e), providing a corresponding plurality of said holders connected to said support member and projecting out in different directions therefrom;

in step (f), positioning one of said first drinking vessels on each of said holders, and positioning one of said second drinking vessels beneath each said first drinking vessel;

in step (g), filling each of said first drinking vessels with said first beverage, and filling each of said second drinking vessels with said second beverage; and, in step (h), pulling each of said second drinking vessels away from said support member.

* * * * *

UNITED STATES PATENT AND TRADEMARK OFFICE

CERTIFICATE OF CORRECTION

PATENT NO. : 8,104,629 B1
APPLICATION NO. : 12/321662
DATED : January 31, 2012
INVENTOR(S) : Scott S. Plumer It is certified that error appears in the above-identified patent and that said Letters Patent is hereby corrected as shown below:

Add -- , -- to col 8, line 22 so that the line now reads:

holder and drops into said second drinking glass, said

Signed and Sealed this
Third Day of April, 2012

David J. Kappos

David J. Kappos
*Director of the United States Patent and Trademark Office*